US012584280B1

(12) United States Patent
Urhausen et al.

(10) Patent No.: US 12,584,280 B1
(45) Date of Patent: Mar. 24, 2026

(54) BERM SYSTEM AND BERM SUPPORTS

(71) Applicant: DLX Enterprises, LLC, Eugene, OR (US)

(72) Inventors: Jonathan Urhausen, Eugene, OR (US); Adam Barr, Eugene, OR (US); Michael Zahendra, Eugene, OR (US); Michael Hitchcock, Eugene, OR (US); Donald Bierman, Eugene, OR (US); Andrew Oslovar, Eugene, OR (US); Oscar Ceron, Eugene, OR (US)

(73) Assignee: DLX Enterprises, LLC, Eugene, OR (US)

( * ) Notice: Subject to any disclaimer, the term of this patent is extended or adjusted under 35 U.S.C. 154(b) by 0 days.

(21) Appl. No.: 18/739,989

(22) Filed: Jun. 11, 2024

Related U.S. Application Data

(63) Continuation-in-part of application No. 18/659,832, filed on May 9, 2024.

(60) Provisional application No. 63/465,328, filed on May 10, 2023.

(51) Int. Cl.
*E01H 1/00* (2006.01)
*B65D 90/24* (2006.01)

(52) U.S. Cl.
CPC ..... *E01H 1/001* (2013.01); *B65D 90/24* (2013.01)

(58) Field of Classification Search
CPC ..... B65D 5/36; B65D 5/3607; B65D 5/3692; B65D 90/24; F16N 31/002; F16N 31/006; F16L 55/00; B06B 17/025; B64F 1/32; B64F 1/36; B08B 17/025; B08B 17/00; B64D 1/16
See application file for complete search history.

(56) References Cited

U.S. PATENT DOCUMENTS

| | | | | |
|---|---|---|---|---|
| 5,762,233 | A * | 6/1998 | Van Romer | B64F 5/30 220/9.1 |
| 6,880,720 | B2 * | 4/2005 | Van Romer | F16N 31/006 220/573 |
| RE39,971 | E | 1/2008 | Van Romer | |
| 7,506,777 | B2 | 3/2009 | Ramp et al. | |
| 8,464,885 | B2 * | 6/2013 | Ramp | F16N 31/006 220/9.1 |
| 8,733,579 | B2 | 5/2014 | Claeys | |
| 8,955,703 | B2 * | 2/2015 | McAtarian | F16N 31/002 220/666 |
| 9,243,415 | B1 | 1/2016 | Claeys | |
| 9,551,163 | B2 * | 1/2017 | Anaya Perez | E04H 7/20 |
| 9,745,124 | B2 * | 8/2017 | McDowell | E02D 31/002 |
| 10,513,389 | B1 | 12/2019 | McDowell | |
| 10,518,967 | B2 | 12/2019 | Claeys | |
| 10,913,597 | B1 | 2/2021 | Claeys | |
| 2021/0001387 | A1 * | 1/2021 | Yaremenko | B08B 17/025 |

* cited by examiner

*Primary Examiner* — Daphne M Barry
(74) *Attorney, Agent, or Firm* — MacCord Mason PLLC

(57) ABSTRACT

Berm systems, apparatus, methods, kits, and berm supports are shown and described. A berm containment system may include a berm and a set of berm supports. A berm may include a set of end walls, a set of side walls, a berm floor, a berm inner face and a berm outer face. A berm support may include a first arm and a second arm, a flap and a panel. The berm support may include a pocket. The berm support may be mated with the berm to support the berm walls and ends under load. The berm may be alternated between a support position and a blank position to be easily assembled, stored, and transported.

21 Claims, 20 Drawing Sheets

BERM SYSTEM AND BERM SUPPORTS

This application is a continuation in part of application Ser. No. 18/659,832 filed May 9, 2024, which claims the benefit of U.S. provisional application No. 63/465,328, filed May 10, 2023, which are incorporated herein by reference in their entireties.

FIELD OF THE TECHNOLOGY

The present disclosure relates generally to berm systems, and more particularly to improved berm support devices, apparatus, kits, and methods.

BACKGROUND

As building, development and construction expand at increasing rates and more traffic flows along highways, natural disasters and accidents create progressively more environmental impacts. Efforts to contain spilled or leaked items, for example fluids that could be harmful to the environment, resulting from disasters and environmental events, often lead to the use of berm containers.

In many instances, such as, responding to emergency situations, response is most effective the faster it is employed. Such response is also typically during challenging scenarios in places requiring deployment, and difficult to set up and reach with heavy and bulky gear.

Berms conventionally have been bulky, heavy, expensive, difficult to deploy, not reliable, and/or lack durability.

Therefore, Applicants desire systems and methods for berms and berm supports to improve fluid containment without the drawbacks presented by the traditional systems and methods and incorporating state of the art enhancements.

SUMMARY

In accordance with the present disclosure, berm and berm support devices, systems, and methods are provided for containment of fluids, chemicals, powders, and spilled or leaked materials. This disclosure provides improved systems and devices that are convenient, efficient, durable, economical, and reliable, particularly when used in difficult, challenging emergency deployment scenarios and the like.

One embodiment of the present disclosure includes a berm containment system including a berm having a set of end walls, a set of side walls, a berm floor, a berm inner face and a berm outer face and a set of berm supports. The set of berm supports may mate with the berm along the berm outer face.

In some examples, a berm support includes a first arm, a second arm, a flap, and a panel. The berm support may include a blank position and a support position and is adapted to be alternated between the blank position and the support position. The berm support may include a pocket flap forming a pocket.

In particular embodiments, inventions of the present disclosure include a berm system kit. Some examples include a berm support system. Still other embodiments include a method for supporting a berm and/or berm system.

Berms of the present invention may be useful for containment of spilled items. By way of example, agricultural materials are transported regularly and during the transport process may be accidentally discharged, food items, chemicals, liquids, etc. can all be destructive or obstructive when spilled. Likewise, emergency personnel use berms to contain fluids, such as in decontamination showers, when on site during emergency response scenarios.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
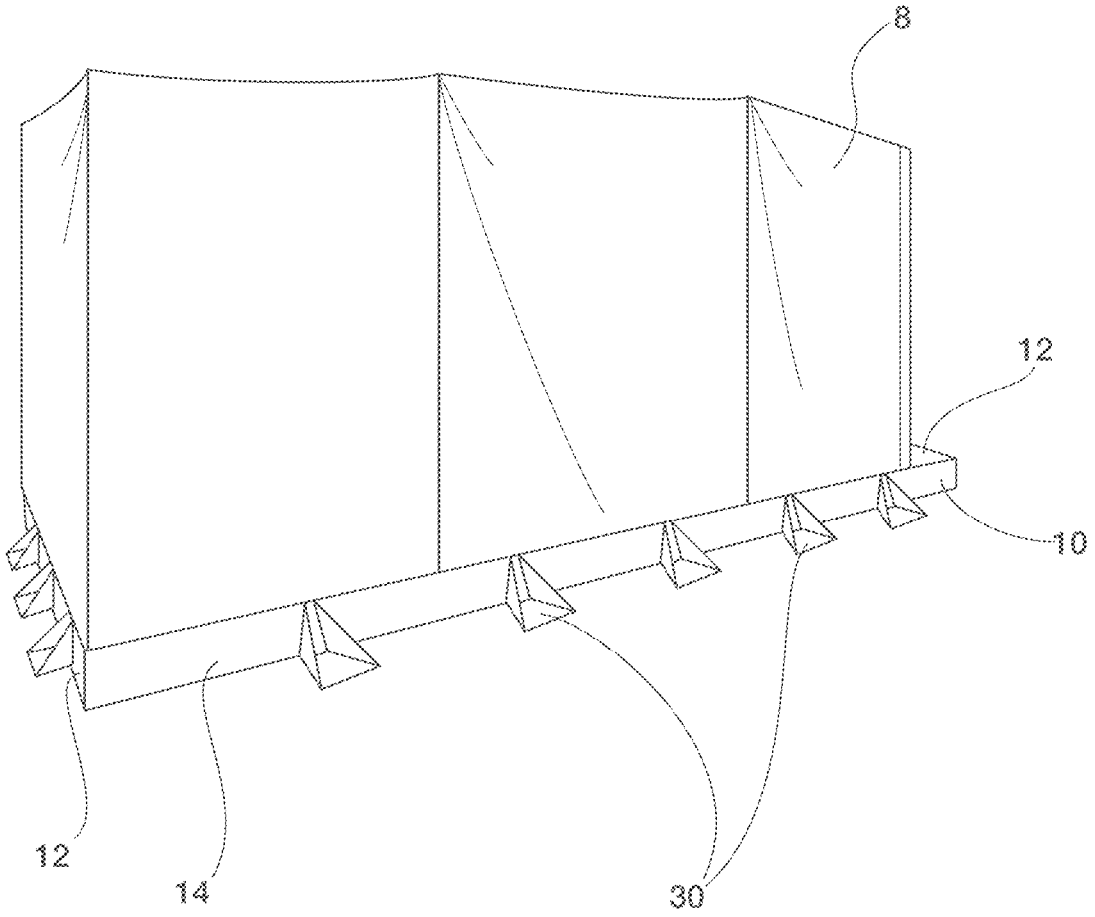
FIG. 1 is one example of a front perspective view of a containment shower having a berm system according to an embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing embodiments of the disclosure and are not intended to limit the disclosure or any invention thereto. FIG. 1 shows a decontamination shower 8, having a frame 9, and a berm 10, including more than one berm support 30.

Figure 10:
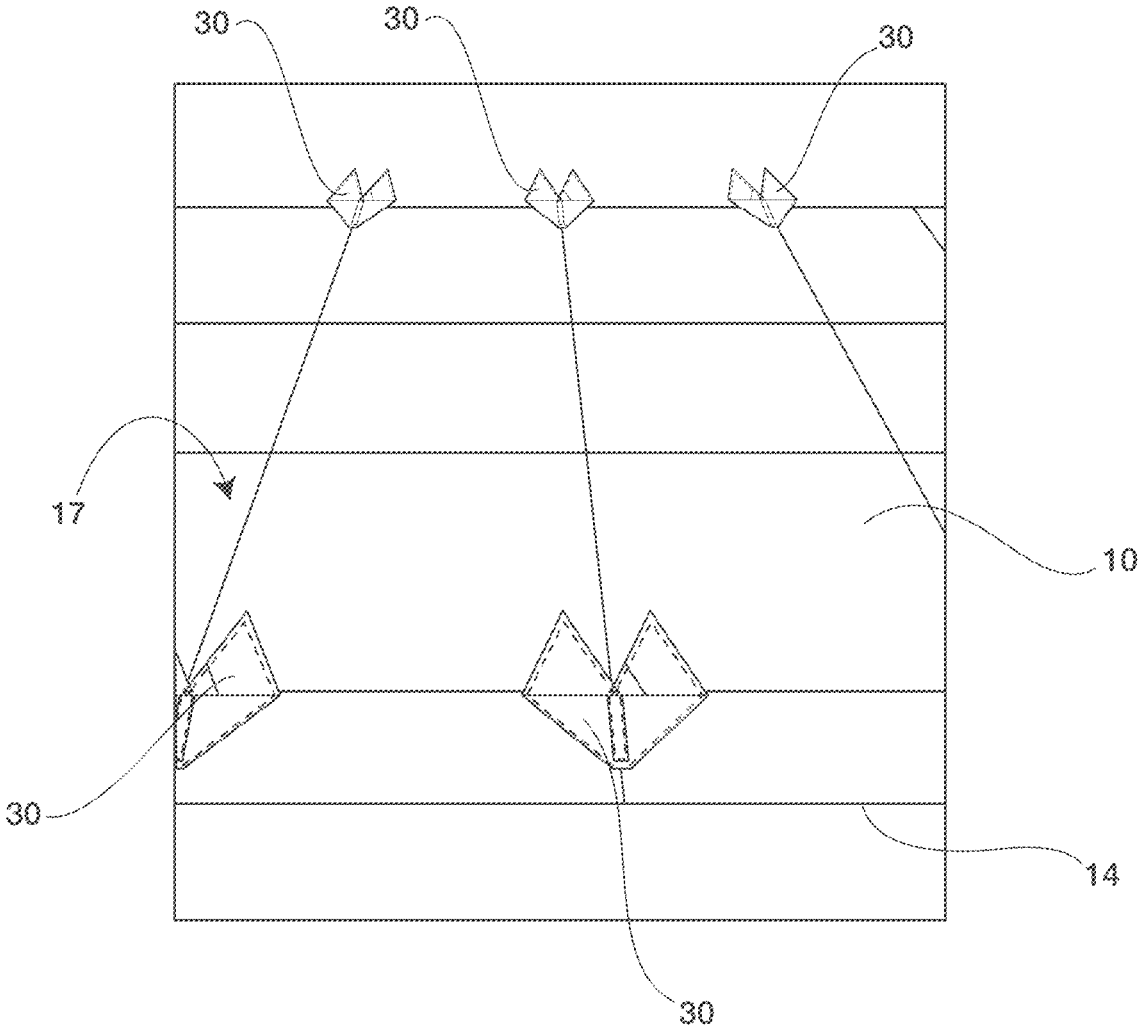
FIG. 10 is a top perspective view of one example of a berm system having a set of berm supports according to an embodiment of the disclosure.
Figure 11A:
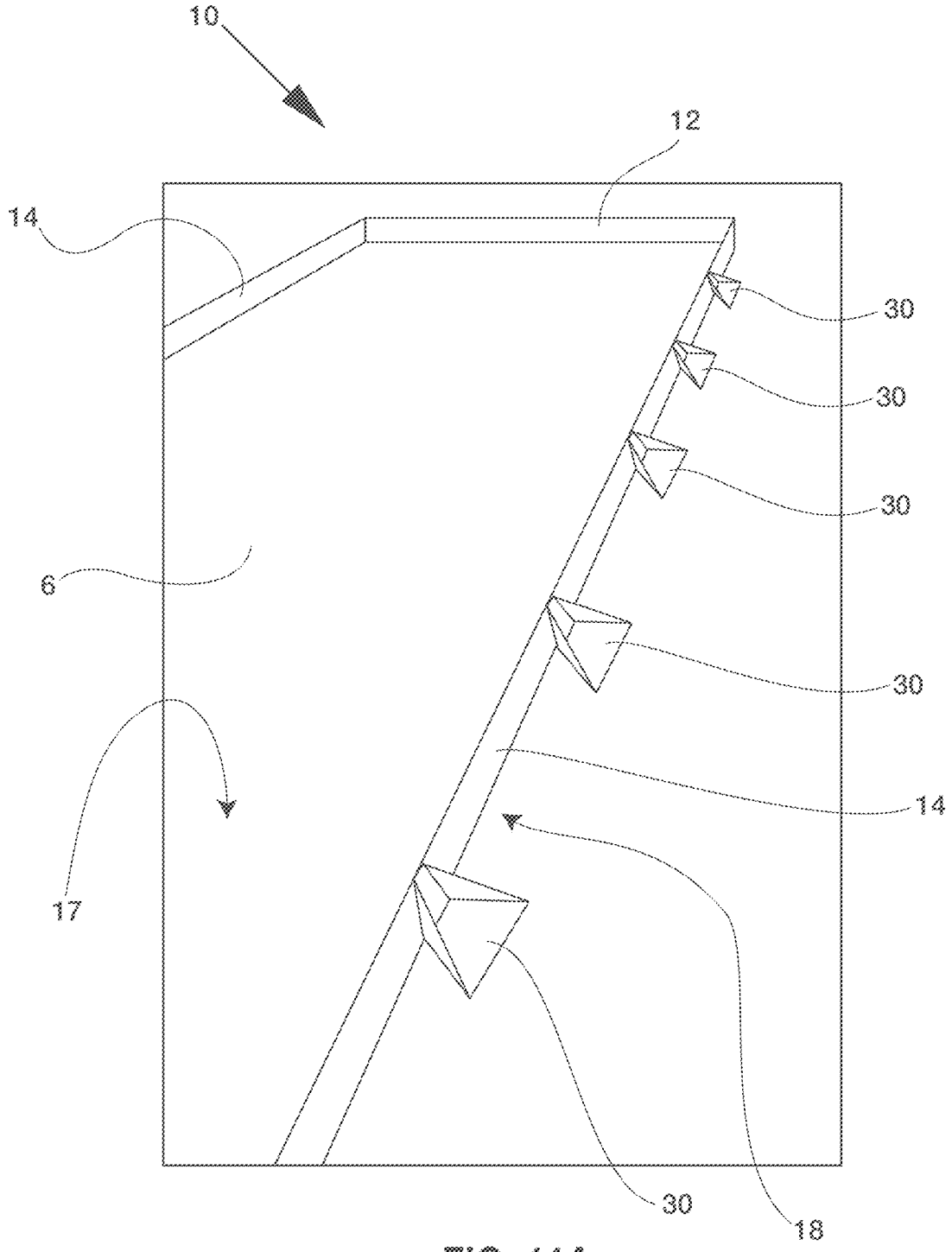
FIG. 11A is a perspective side view of an example of a berm system having a set of berm supports according to an embodiment of the disclosure.
Figure 11B:
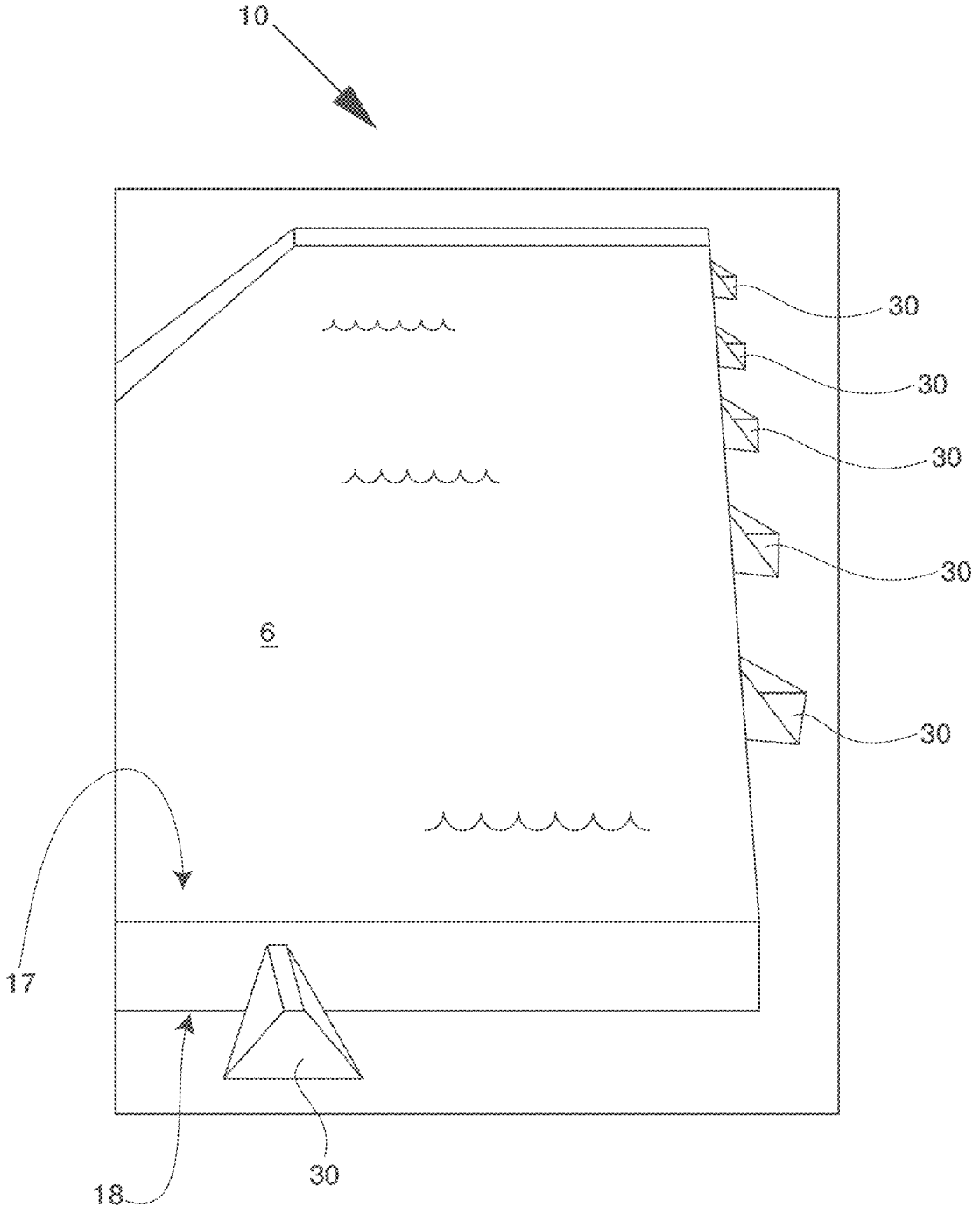
FIG. 11B is a perspective end view of an example of a berm system having a set of berm supports of FIG. 11A and according to an embodiment of the disclosure.
Figure 13A:
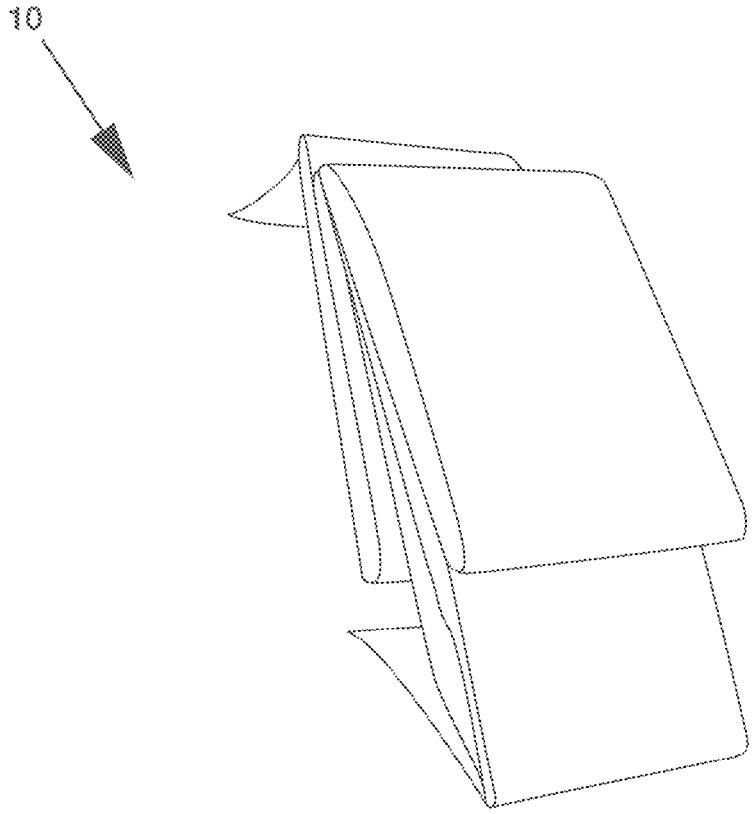
FIG. 13A-B show examples of a berm in a packed position for transport and storage according to an embodiment of the disclosure.
Figure 13B:
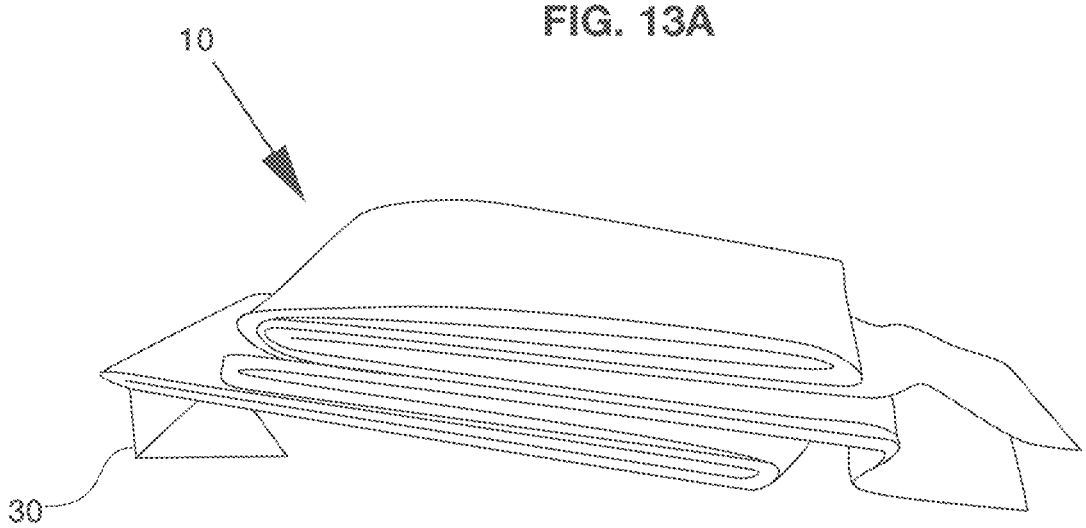
Figure 14:
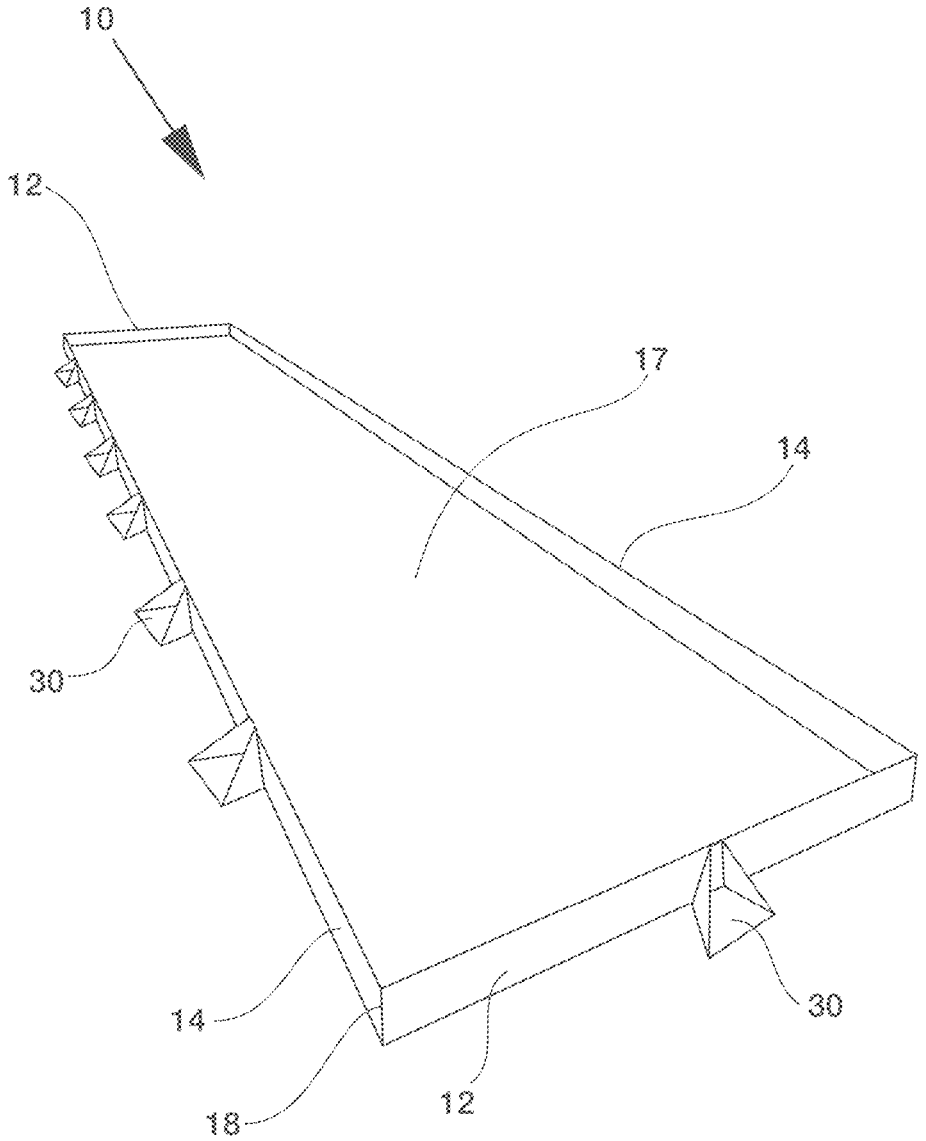
FIG. 14 is an end perspective view of one example of a berm having berm supports in a deployed position.

Berms 10 are often utilized, by way of example, along with decontamination showers, effluent and runoff containment. Berms 10 may be constructed, in some embodiments of any or all, by way of example, of polyester, polyvinyl chloride, synthetic rubber, polyethylene, polypropylene, rubber, other flexible liquid containing materials, and/or combinations of such materials. Berm 10 may be portable. Berm 10 may include a deployed position (as shown in FIG. 1), a planar position (as shown in FIG. 10, and a packed position (shown for example in FIG. 13A-B) for movement between locations.

Figure 12A:
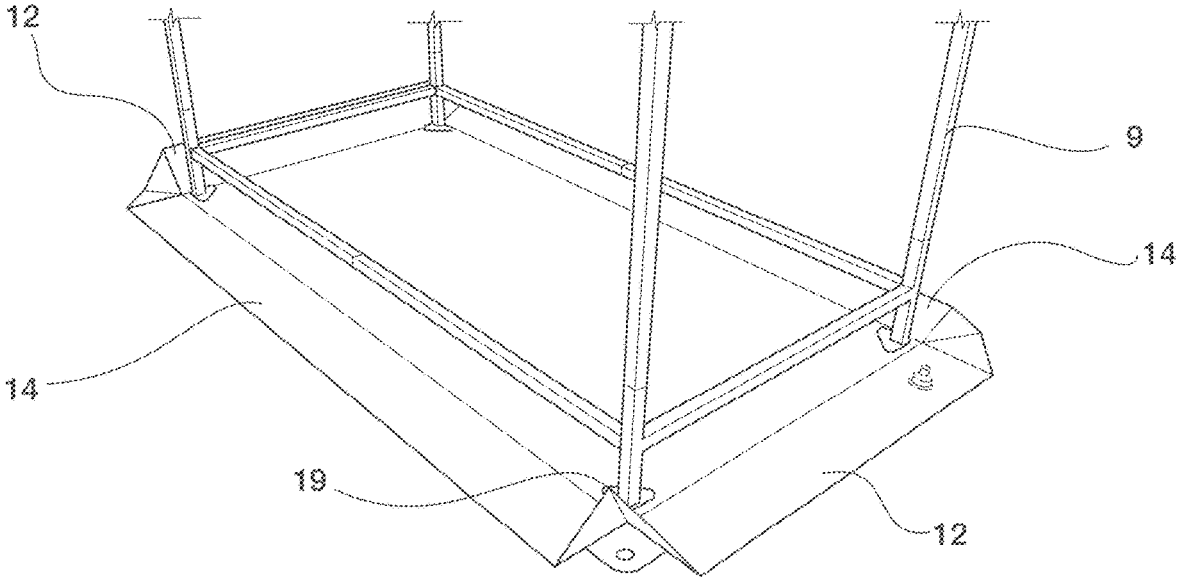
FIG. 12A-C is an end perspective view of one example of a corner of a berm system according to an embodiment of the disclosure.
Figure 12B:
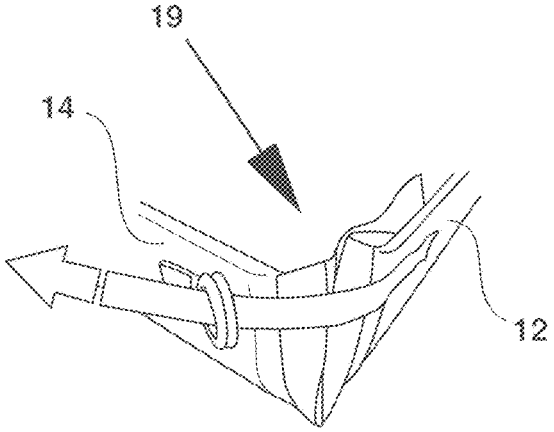
Figure 12C:
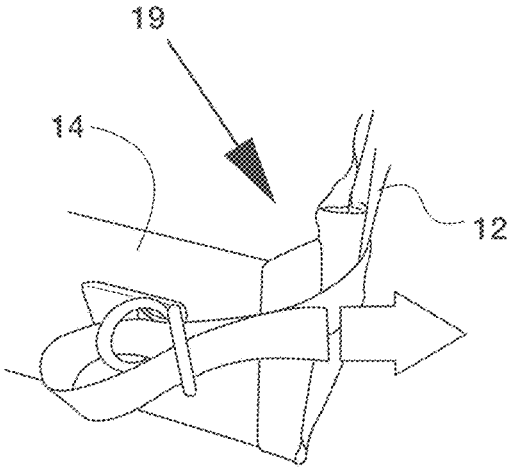

A Berm 10 may include an end wall (or set of end walls) 12, a side wall (or set of side walls) 14, and a floor 16. The berm 10 may, in particular examples include, an inner berm face 17, an outer berm face 18, and berm corners 19. A berm corner 19 may be formed where an end wall 12 and a side wall 14 meet. A berm corner 19 may be formed, in some embodiments, by lifting up each adjacent end wall and side wall, taking the corner fabric and folding it into the inside of the berm 10, lacing an attached strap through securing mechanisms, for example attached double-D rings, and fastening with an attached hook and loop (see FIG. 12). The folded corners may be secured with any other securing means, by way of example, snaps, latches, buttons, hook and eye, and/or Velcro attachments. Combinations of these securing/fastening means are also contemplated within the scope of this disclosure.

One or more berm supports 30 may be used with a berm 10 to provide support to the berm 10 and prevent the walls of the berm 12, 14 from collapsing and/or allowing fluid/effluent 6 to spill over. In some examples, 4" of water depth held in a berm can create over 2000 lbs. of weight. If the berm is not sturdy enough, the force can overwhelm the berm support 30 and result in failure of the berm 10. If the berm is sturdy enough, then a challenge becomes the loss of flexibility, deployablity, and maneuverability of the berm supports and thus the berm itself.

A berm 30, in certain examples of the present disclosure, may include a blank position (as seen in FIG. 5-8) and a support position (as seen in FIG. 2-4, FIG. 14). In the blank position, the berm 30 may be flat and/or folded in a non-support manner to be packed for transport to another location or for storage. In a support position, berm 30 may provide reinforcement to the berm walls 12, 14.

Figure 2:
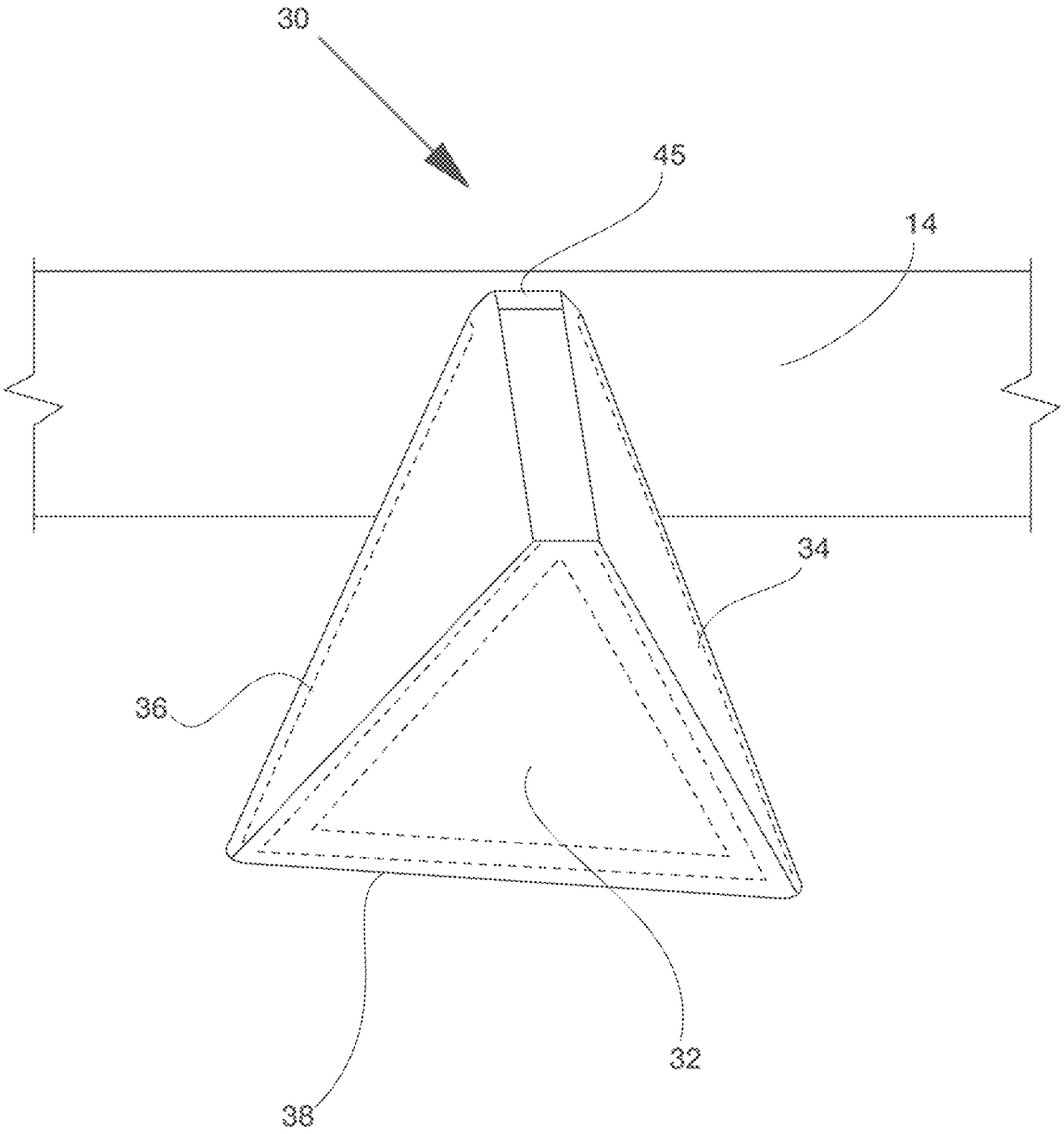
FIG. 2 is a close-up front view of one example of a berm system having a berm support according to an embodiment of the present disclosure.
Figure 3:
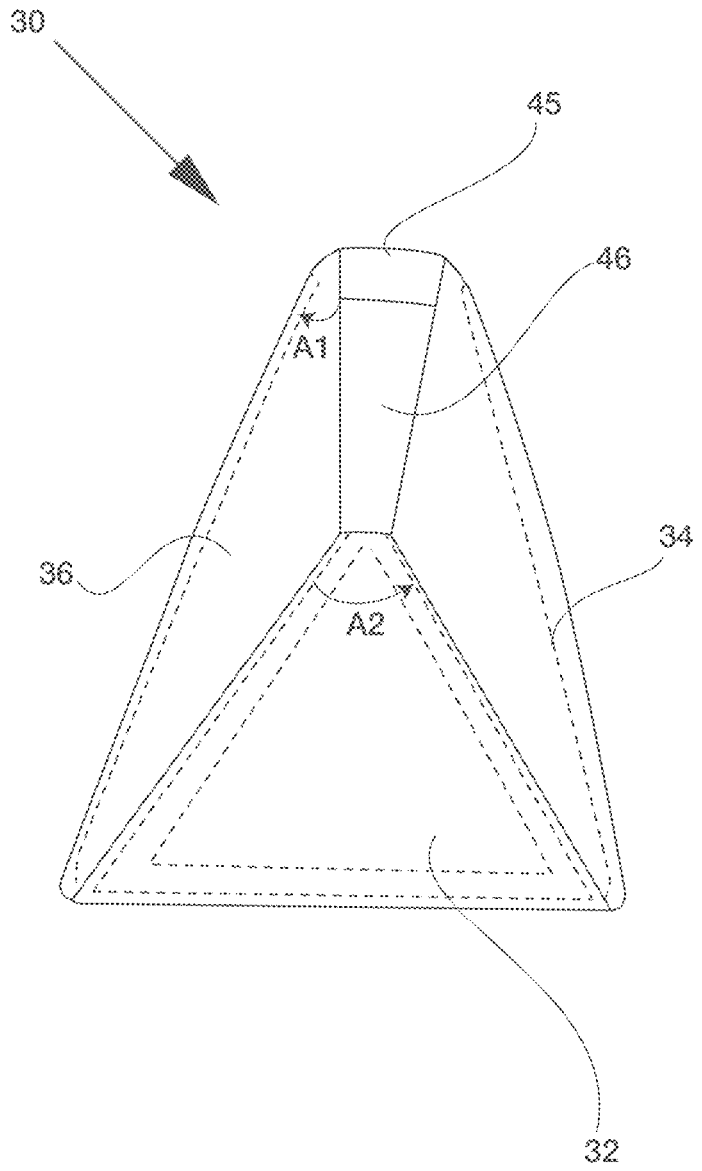
FIG. 3 is a top perspective view of one example of the berm support of FIG. 2 according to one example of the disclosure.
Figure 4:
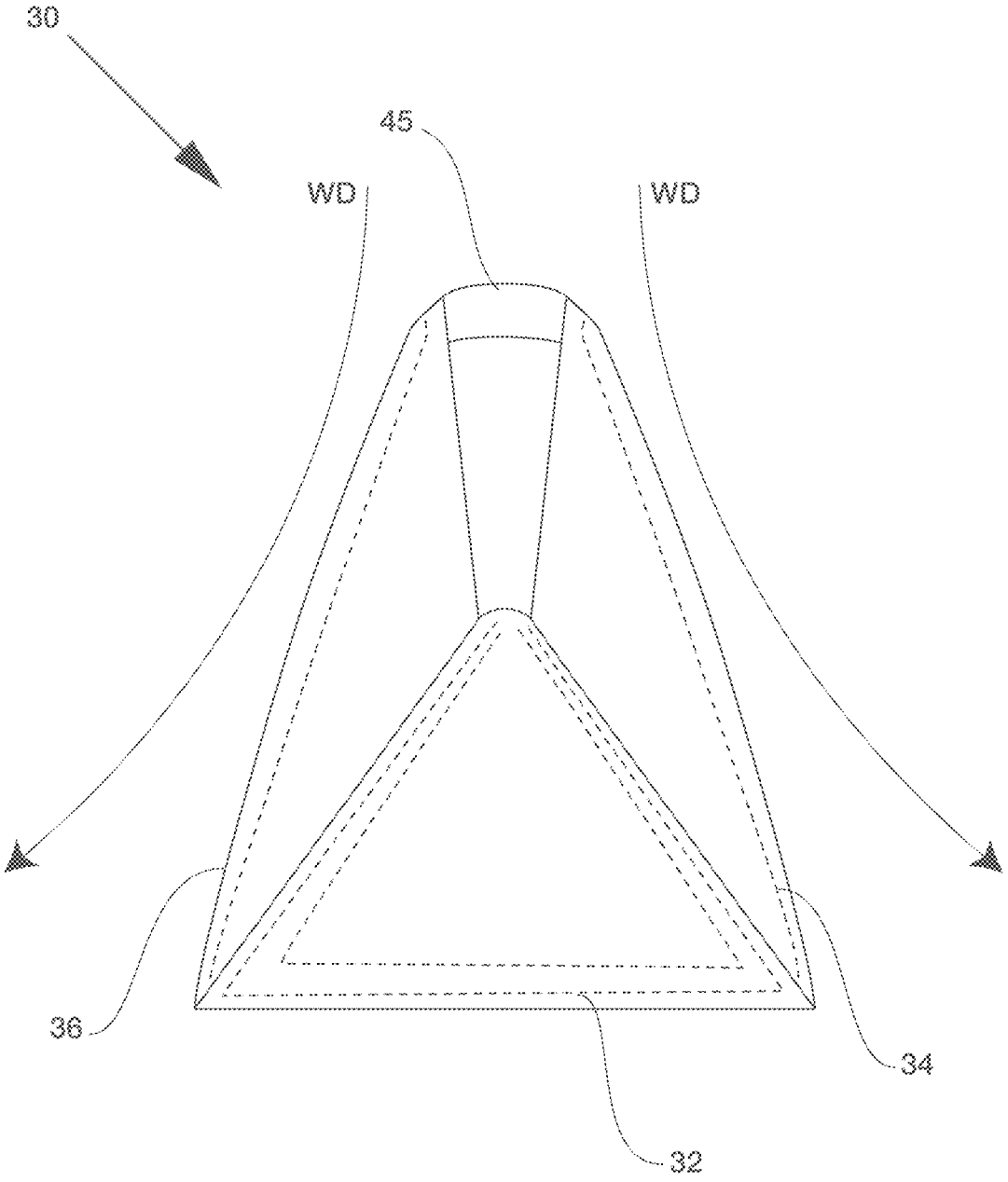
FIG. 4 is a front view of one example of the berm support of FIG. 2 according to one example of the disclosure.
Figure 5:
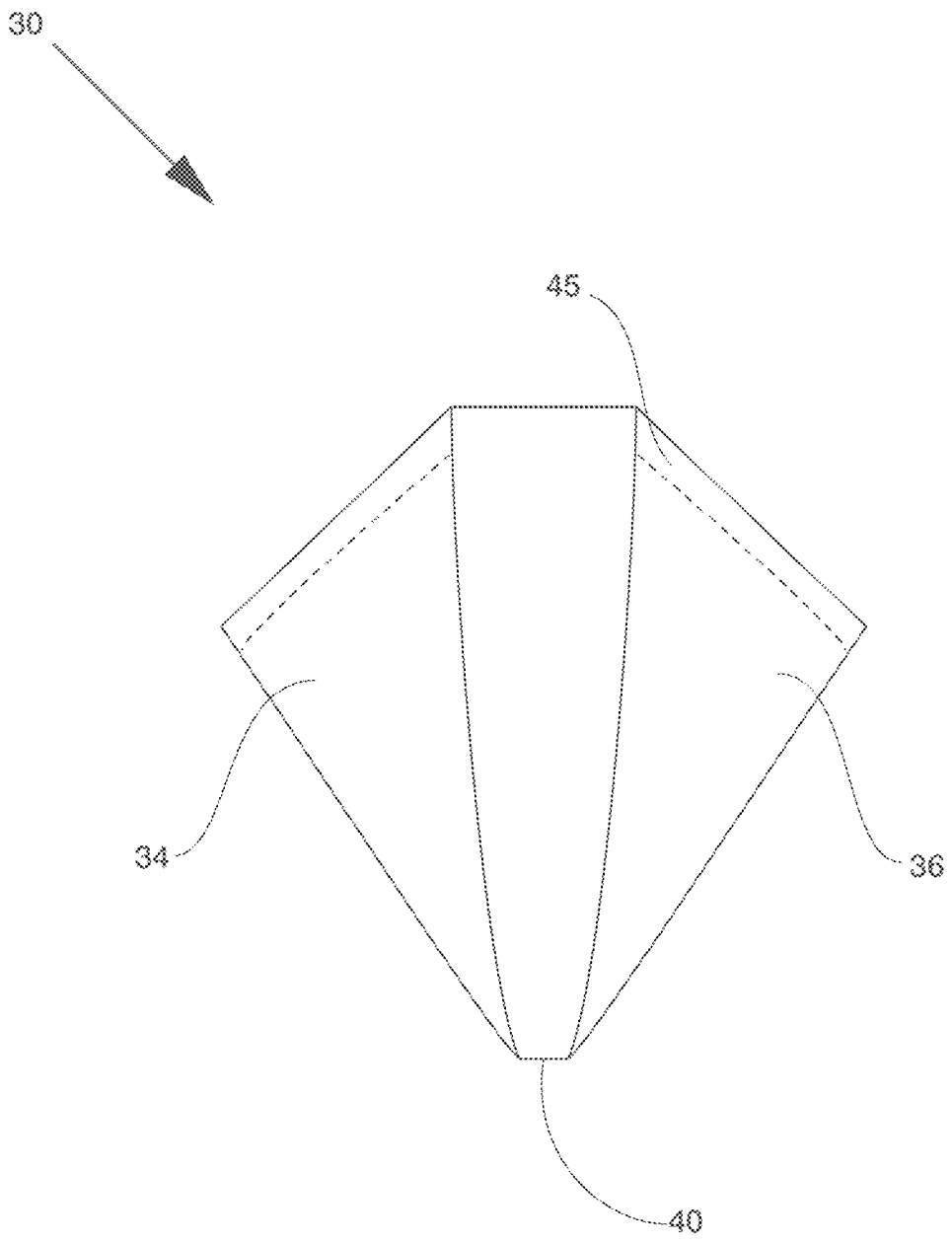
FIG. 5 is a back view of one example of the berm support of FIG. 2 according to one example of the disclosure.
Figure 6:
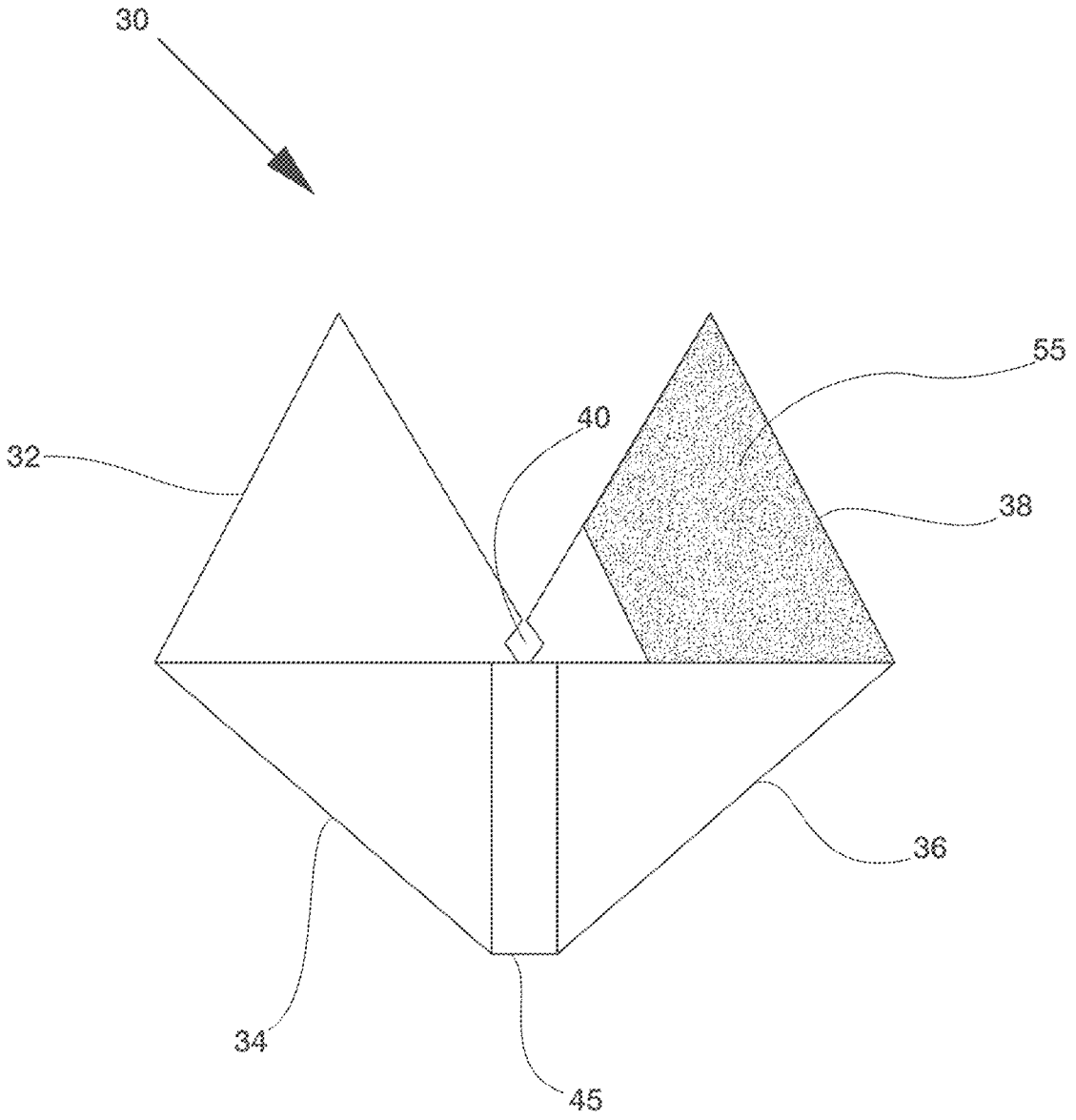
FIG. 6 is a view of one example of the outside face of a berm support in a blank position.
Figure 7:
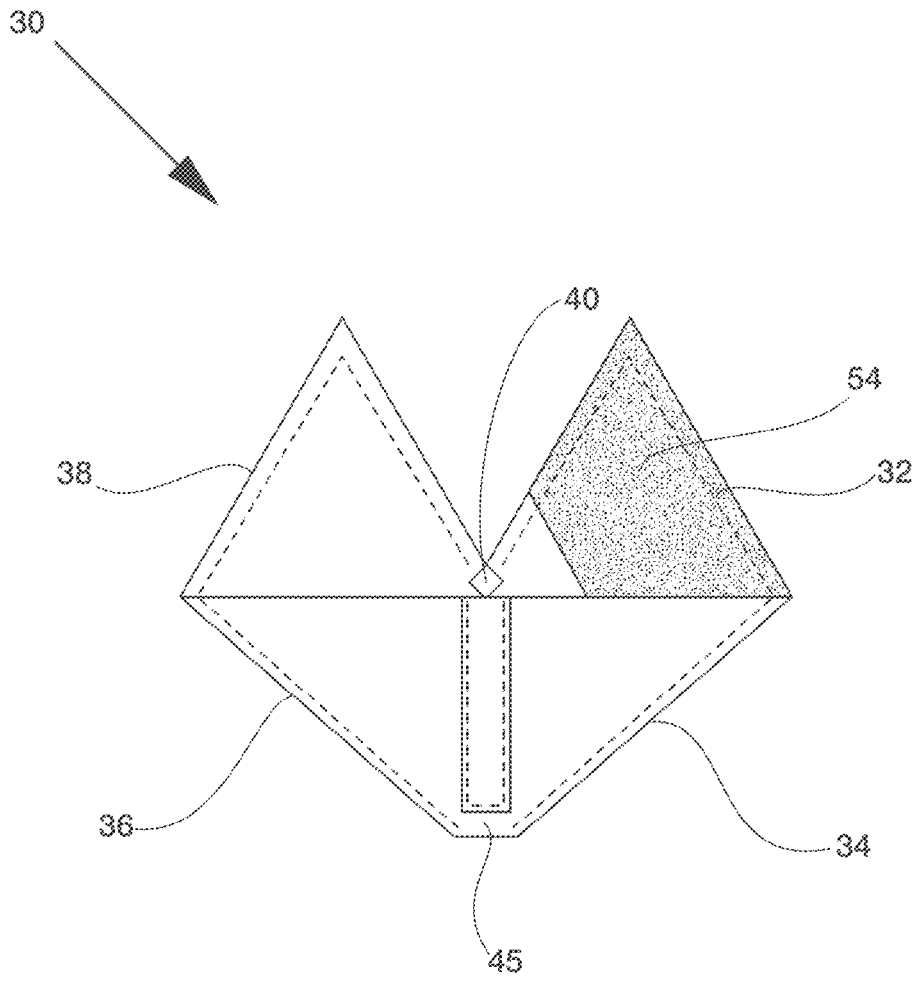
FIG. 7 is a view of one example of the inside face of a berm support in a blank position.
Figure 8:
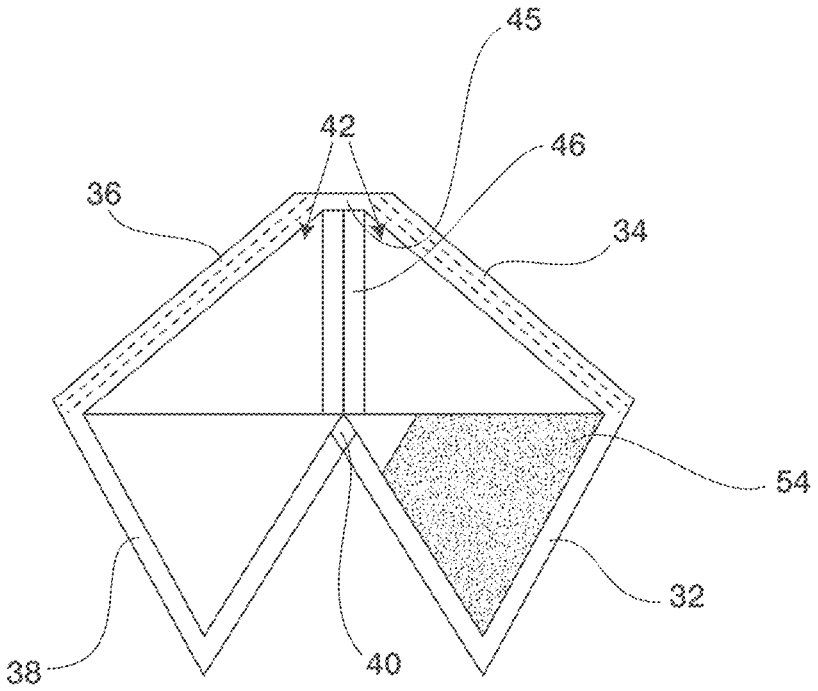
FIG. 8 is an alternative illustration of one example of the inside face of a berm support in a blank position.
Figure 9:
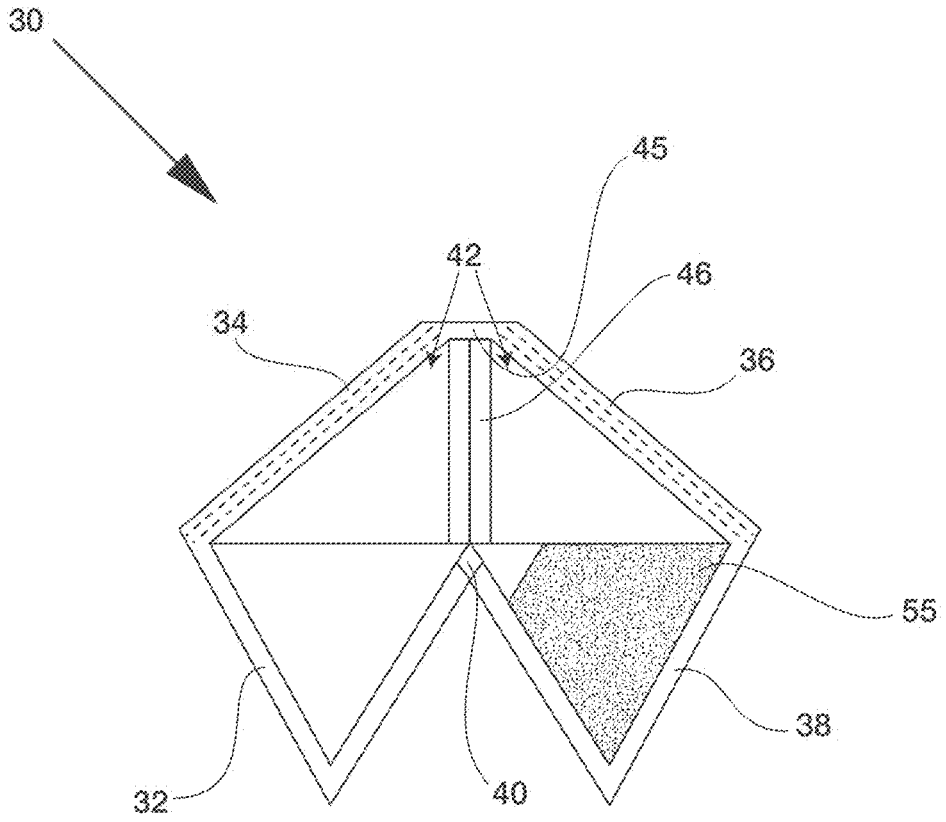
FIG. 9 is an alternative view of one example of the outside face of a berm support in a blank position.

Turning to FIGS. 2-4, embodiments of berm 30 may include a first arm 34, a second arm 36, a panel 32, and a back 45. Back 45 may include a spine 46. Berm 30 may form a pyramidal structure, and by way of example a tetrahedron structure, in the support position. A central point 40 may be formed at an apex of the support structure. There may, in some embodiments, be an open space at central point 40.

FIGS. 5-8 show examples of a berm 30 in a blank position. Blank 30 may include the first arm 34, second arm 36, panel 32, back 45, and also flap 38. Panel 32 and/or Flap 38 may include a connective face 54, 55. Connective face 54, 55 may be considered any connective structure, by way of example, hook and loop Velcro attachment, button, snap, adhesive, hook and eye, etc.

First arm 34 and/or second arm 36 may each include an insert 42. Insert 42 may be embedded within first arm 34 and second arm 36 and/or may form a layer of the arms 34, 36. The insert 42 may take on the shape of the respective arm 34, 36. The insert 42 may provide a resilience to the arms 34, 36 to prevent collapse or folding of the arms 34, 36 when under load from a weighted berm 10. Insert 30 may be, in certain examples, made of plastic and/or metal, examples of plastic being polyethylene, polypropylene, nylon, ABS, polycarbonate, UHMW, and/or combinations thereof. The first arm 34 and/or second arm 36 may each be structured to take on the shape of a right triangle. It may be considered within the scope of inventions of this disclosure for the arms 34,36 to take on the shape of equilateral triangles, isosceles triangles, and any other shaping. In some embodiments, the first arm 34 and second arm 36 are separated by back 45. First arm 34 may attach with the back 45 on one side and with either the panel 32 or flap 38 on another side, with the second arm 36 attaching to the back 45 one side and either the panel 32 or flap 38 on another side. The arms 34, 36 may also attach with an end of the back 45 along the same side of attachment with the panel 32 or flap 38.

The panel 32 and flap 38 may by way of example take on the shape of equilateral triangles. The panel 32 and flap 38 may overlap and secure with one another to form a base for the berm 30, the base including a floor face. The connective face 54, 55 may secure with one another and secure the panel 32 and flap 38 in place, one atop the other. When the panel 32 and flap 38 secure one to another, the berm 30 may take on the support shape. The berm in the blank position may take on the shape of an irregular pentagon. The berm 30 in the blank position may include four triangular pieces with one open triangular section. The open triangular section may be placed between the panel 32 and flap 38. The open triangular section may fit with the panel 32 and flap 38 in an opposite/reverse positioning. The open triangular section may separate the panel 32 and flap 38. The panel 32 may attach with one of the arms 34, 36 and the flap 38 may attach with the other of the arms 34, 36.

When configured into the support position, the berm 30 may include three walls in a tetrahedron formation. Berm 30 in the support position may also include a back 45. Back 45 may have a flat outer face. The flat outer face may provide a flat surface. Back 45 may interface with a berm 10 to connect the berm support 30 securely to the berm 10. The berm support 30 may be, by way of example, permanently or intermittently/removably connected to the berm 10.

In particular examples, the first arm 34 and second 36 are less bendable (stiffer) than the panel 32 and flap 38, which retain their flexibility for breakdown and storage of the berm 10 with berm supports 30.

A loaded berm exerts pressure outward on the berm walls. The berm supports 30, in particular examples, align with backs 45 against the berm walls and with the base at the floor surface resting on the floor. The berm support 30, in this example, absorbs and resists the force exerted from the effluent on the berm walls and supports the walls in place to keep them reinforced. As seen in FIG. 4 at lines WD, the load on the Berm 30 has a downward weight distribution through the first arm 34 and second arm 36. The arms 34, 36 are reinforced with inserts 42. The downward weight distribution attempts to skew the base outward at the corners, however, the panel 32 and flap 38 are securely attached to one another preventing separation at the base. The more force applied to the top of the berm 30, the more weight distribution occurs through the arms 34, 36 and through the base. The berm 30 is thus able to support and reinforce the berm walls when fluid is being contained and yet, retain the ability to be disassembled into the blank form to take up minimal space during transport and storage of the berm and berm supports.

The berm support 30 may be able to alternate between a blank position and a support position. In some examples, the berm support 30 may be permanently attached to the berm 10, by way of example, the berm support 30 welded to the berm 10. In one embodiment, the spine 46 may be vinyl, and/or may include a welding bar. The spine, in some examples, may be where the weight of the berm 10 impact the berm support 30. The weight of the water filled berm 10 presses against the spine 46 of the berm support 30, which then attempts to force the first arm 34 and second arm 36 apart and into the ground. The force from the berm 10 is divided between the arms and force distributed through the arms (as shown in one example in FIG. 4 WD) by way of the arms 34, 36 and not at a 90 degree angle from the berm 10. The weight is divided between the arms that are supported at the ground level and secured against outward motion by the interfacing panel and flap. The weight is therefore divided and transferred sideways through the arms 34, 36 which are restricted by the connective face 54, 55 and the, by way of example, 60 degree portion fastened with the connective face at the base. In some examples a 40-70 degree portion may be fastened with the connective face at the base. Degrees outside the exemplary ranges provided are considered within the scope of this disclosure.

In some embodiments, the inventions of the present disclosure may include a berm 10 containment system. In certain examples, the berm containment system may include a berm having a set of end walls, a set of side walls, a berm floor, a berm inner face and a berm outer face and a set of berm supports. The set of berm supports mate with the berm along the berm outer face. A berm system may contain, in some embodiments, layers of welded and sewn vinyl around rectangular plastic inserts in the side walls, and/or end walls. Attached webbing (straps) with hook and loop may include and utilize webbing bound D-rings. Safety signage ("watch your step", "danger" etc) and handles may also be attached. The size, shape and number of berm supports for end walls and side walls may vary by dimensions of the berm. Supports can also scale up larger for taller side and end walls. The number of berm supports may also be based on type of entrance or egress expected, by way of example is the side going to be expected to be "rolled over" by wheels on ambulance stretchers, car/truck tires, wheel chairs, etc. In certain examples, berm supports may be provided at about a range of between 3-8 feet along berm end/side walls. In certain embodiments, at least one berm support along an end walls and at least 2 berm supports alongside walls may be provided in a berm system.

The expected maximum load on the berm 10 may be a factor in determining the number of berm supports provided or used with a berm. For example, if the amount of water in the berm 10 is expected to be sustained above the top of the berm support continuously, then the distance between the berm supports may be decreased and the number of berm supports increased. In Applicant's testing, often liquids in a berm that are in excess of 25%-50% of the total height of the berm support, (e.g., if berm support is 1 ft high, then this suggests that a berm filled with liquid that reaches 1.25'-1.5' may benefit from a taller berm support and/or more berm supports).

Figure 15:
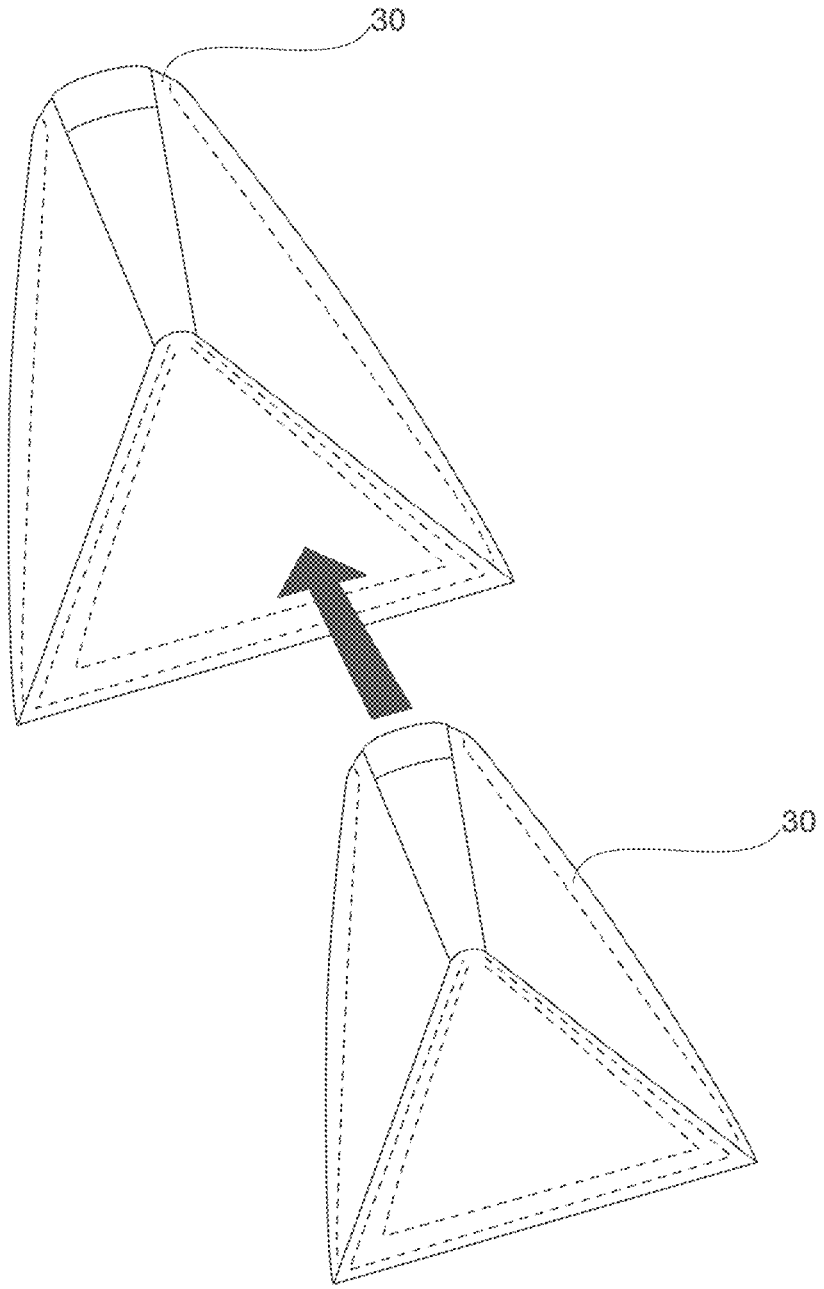
FIG. 15 shows one example of a berm support nesting with another berm support according to embodiments of the present disclosure.
Figure 16:
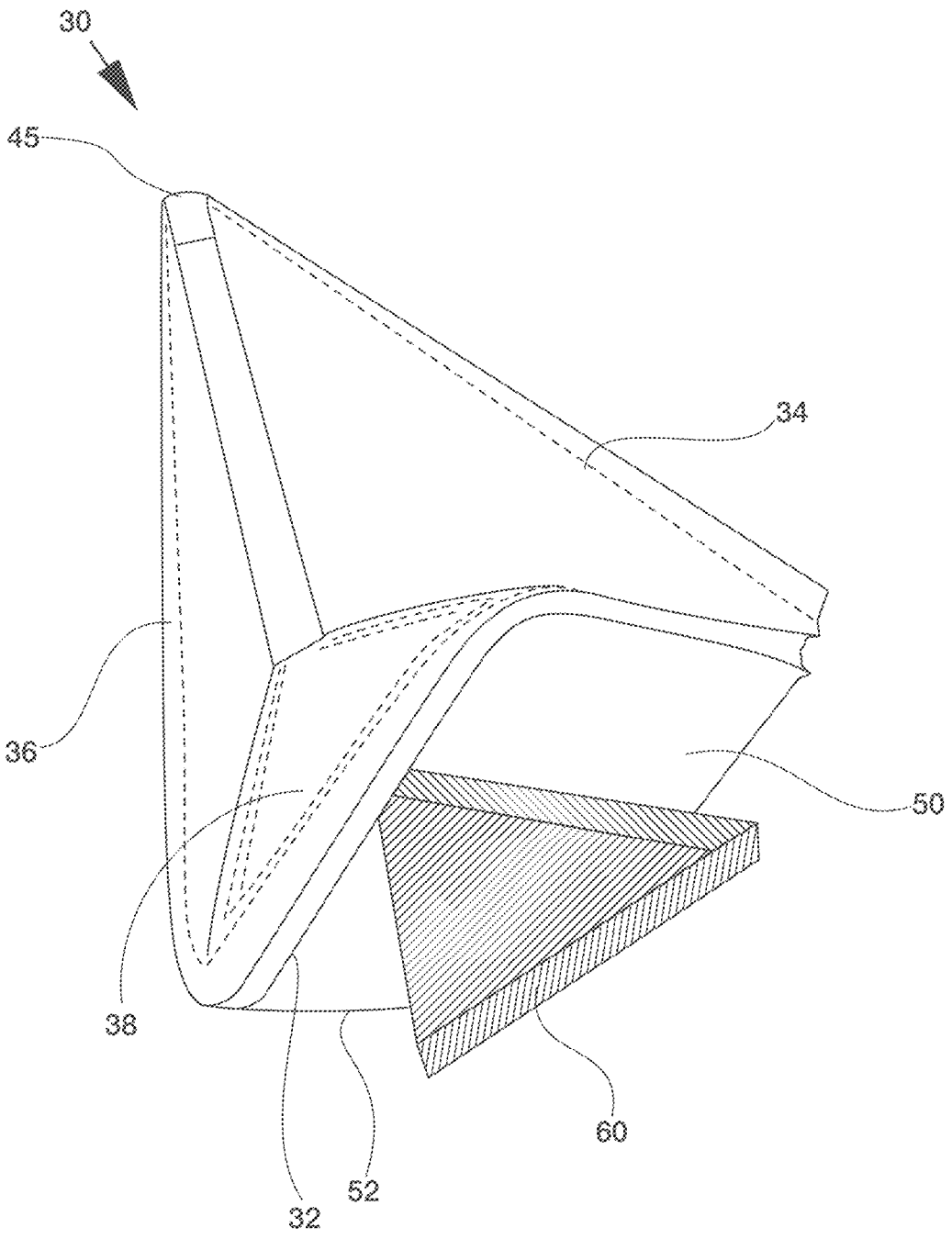
FIG. 16 is one example of a front perspective view of a berm support having a pocket according to an embodiment of the disclosure.
Figure 17:
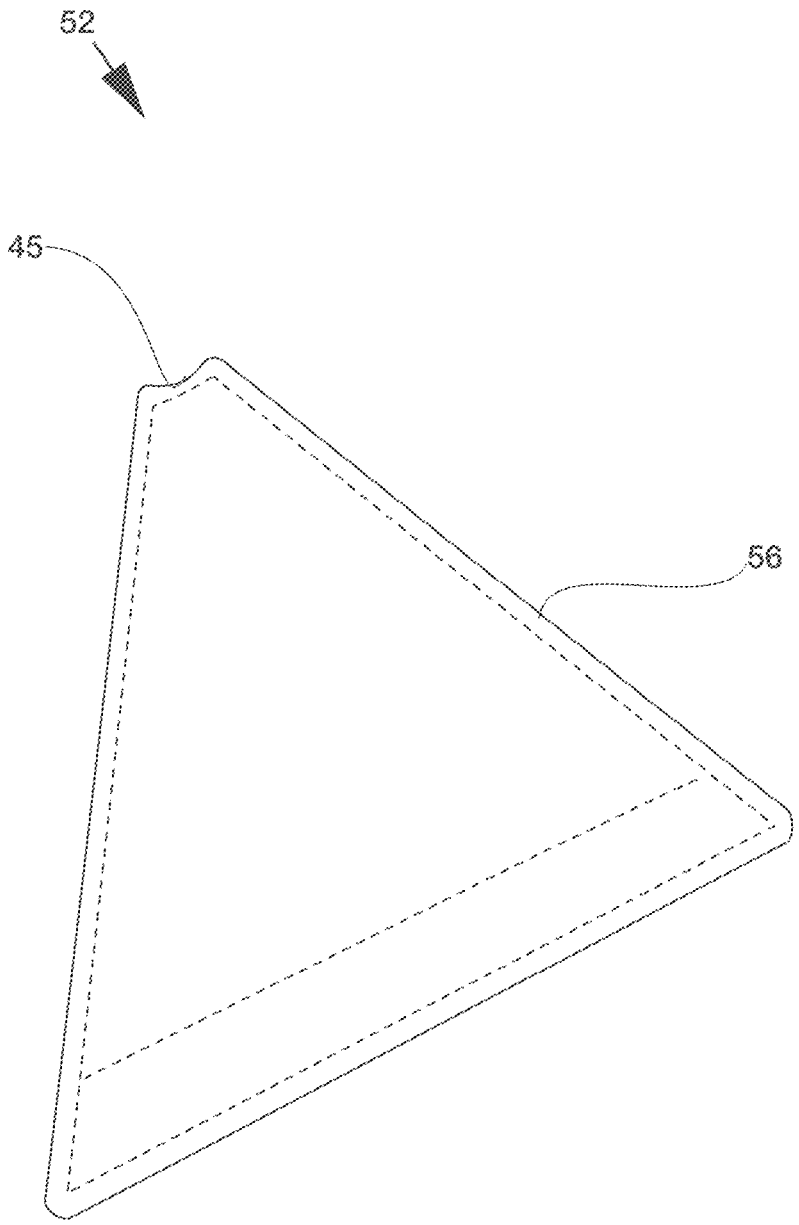
FIG. 17 is a bottom view of one example of a berm support having a pocket according to FIG. 16.
Figure 18:
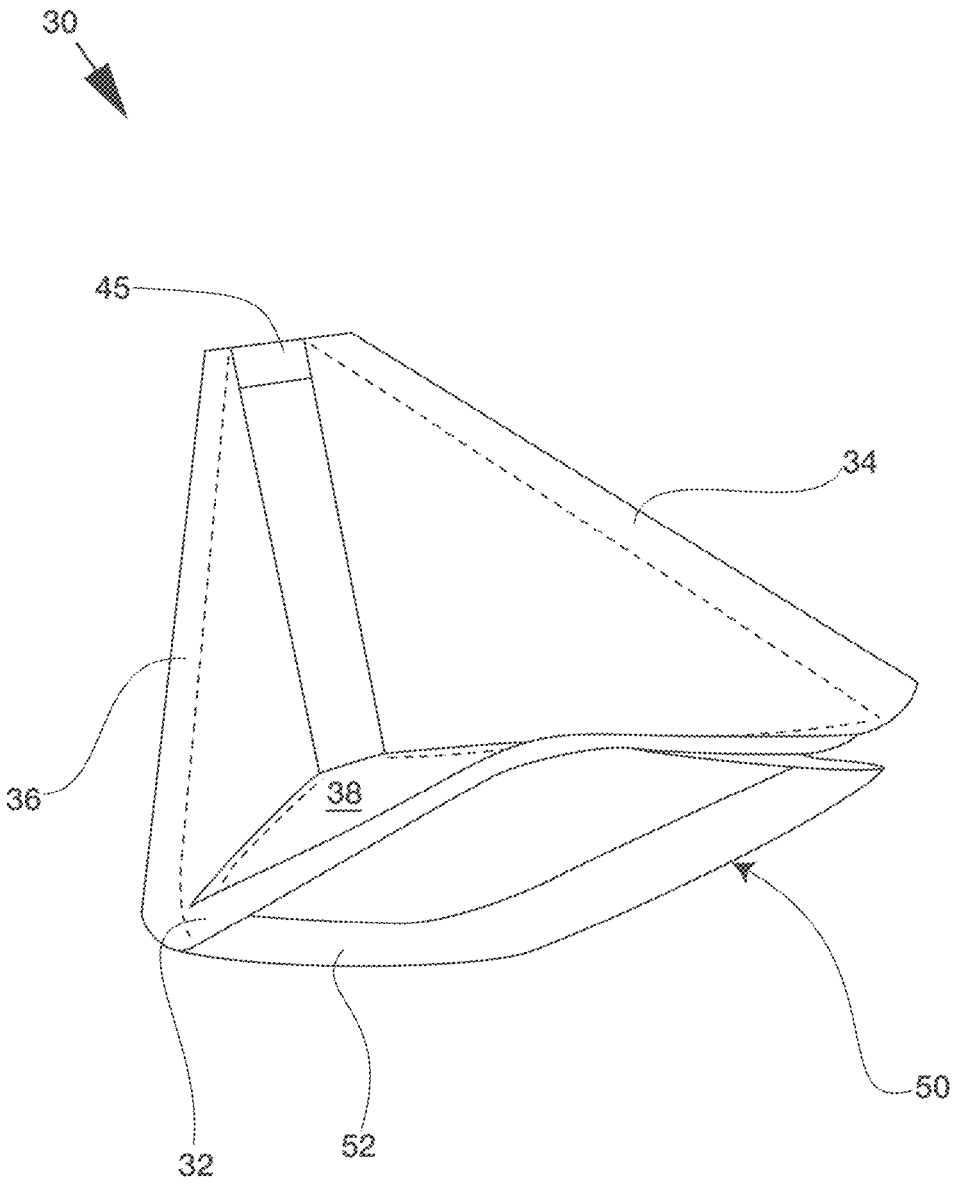
FIG. 18 is an alternative front perspective view of a berm support having a pocket according to FIG. 16.
Figure 19:
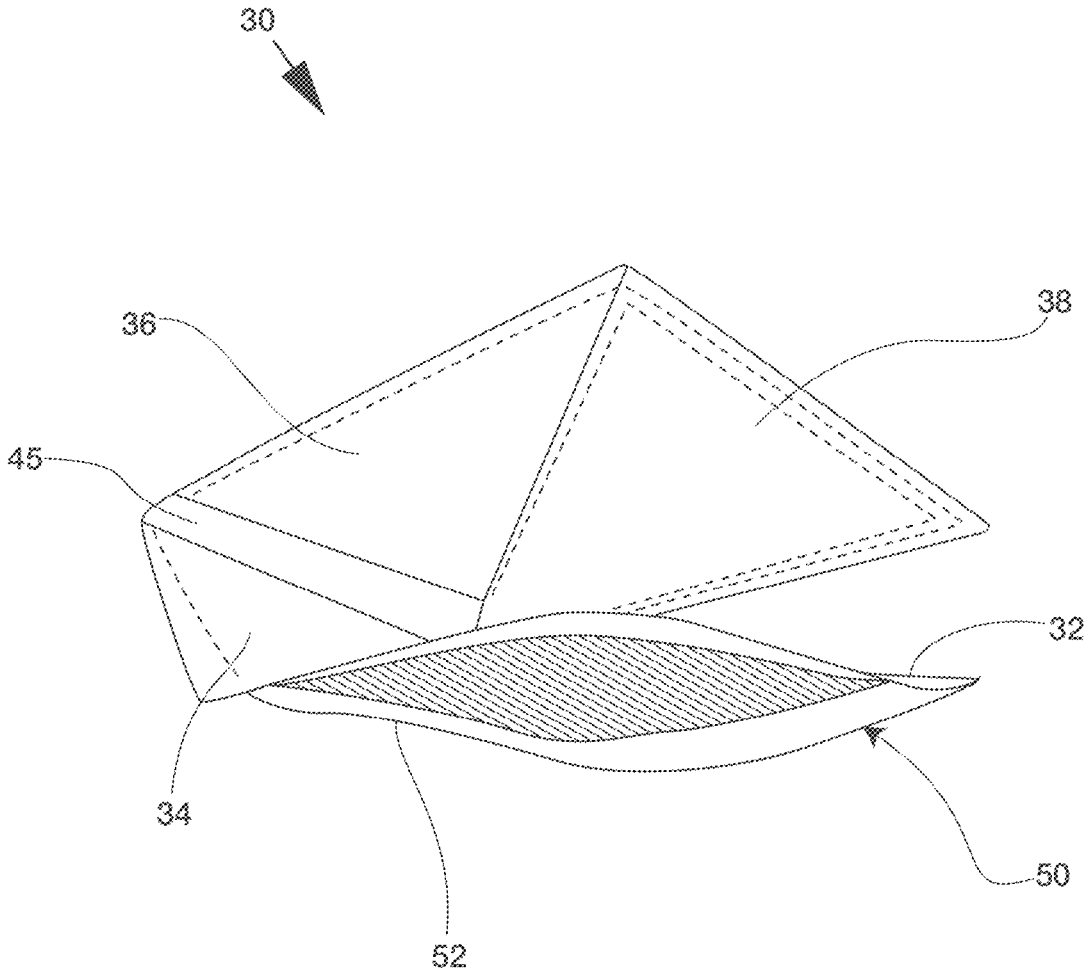
FIG. 19 is a top view of one example of the inside face of a berm support having a pocket in a blank position.

FIG. 15 exemplifies some embodiments where a berm support 30 may be nested with another berm support 30 of equal, lesser, and/or larger size. The back 45 of each nested berm support 30 may at least partially align vertically. The nested berm supports 30 may also be secured one to another, and also secured to the berm 10. The nested berm supports 30 may be removable one from another and/or permanently attached.

In some examples, when changing the berm support into the blank position from the support position, it may be preferable to cover the fasteners on the triangles with a cover to prevent unwanted adherence to the fasteners during stowage. The cover may take the form of a pocket, in some examples, in the same dimensions as one of the equilateral triangles and attached on 2 sides of said triangle, so that the outward facing equilateral triangle can be folded into the pocket securing the triangle's attachment method from inadvertently adhering during stowage. The cover may also in some circumstances take the form of a flap with the reverse attachment as the equilateral triangle flap, in the same dimensions as the outward facing equilateral triangle, which can be attached to the berm support. This flap is then adhered to the equilateral triangle by way of the attachment method, securing it from unwanted adherence during stowage.

In other embodiments, the disclosure includes a berm 10 and/or berm support 30 kit according to any of the embodiments of combination of elements disclosure herein. The disclosure be considered by those of skill in the art to include a berm system including at least one berm and a set of berm supports according to any of the embodiments or any combination of elements and embodiments disclosed herein. The disclosure also includes, in some embodiments, a method for supporting a berm, including any of the embodiments, or combination of embodiments of the present disclosure. The disclosure includes, in some examples, a method for fluid containment, including any combination of the elements of the present disclosure.

FIGS. 16 to 19 show an example of a berm support 30 having a pocket 50 according to an embodiment of the disclosure. A pocket flap 52 may form a pocket 50 for housing a weight/ballast to be inserted into the pocket. Pocket flap 52 may attach to panel 32. The panel 32 may form an upper surface of the pocket 50 with pocket flap 52 forming a lower surface of the pocket 50. Pocket flap 32 may include a bottom surface 56. Pocket 50 may accept a weight 60. Weight 60 may load the berm support 30 to urge an upright position for the berm support 30 when attached to a berm 10 that is not loaded with and containing a substance.

Those of skill in the art will recognize additional benefits of the invention of the present disclosure that are within the scope of the invention. In one example, the berm support 30 may maintain its shape and support functionality when exposed to load, for example fluids, sand, or other materials. In other examples, the berm support 30 provides support to a berm wall under load but still maintains a small footprint. The berm supports 30 are packable, stowable and transportable with a berm 10. Additionally, it may be recognized that the berm support is resilient enough to be stepped on/driven over and is able to resist compressive forces without failure. The inserts may be thick enough to withstand compressive and shear forces without exceeding its modulus of elasticity (E). When a plastic insert is scaled larger/thicker in berm supports for usage with larger berms, the plastic insert can be designed to be thicker, so that it can resist greater forces. Additionally, as the berm support is called upon to resist greater forces due to side wall and end wall height, as well as fluid pressures, stronger materials with a higher modulus of E, such as polycarbonate and nylon can be used to increase the strength of a berm support.

Certain examples of a berm support 30 of the present disclosure may be recognized as a one piece berm support, integrally formed on the exterior, so that there are not pieces to lose or attach and remove. In some instances, multiple inserts 42 may be stacked, included, scaled so that the berm support 30 is scalable in resistance and size.

In some examples, the back may meet with the berm wall at a 90 degree angle. In other embodiments, the back 45 may meet with the berm wall at between an 80 to 100 degree angle. The arms 34, 36 may take on any shape, by way of example any triangular or polygonal shape. In some examples, the arms may include a 45 degree angle away from the top of the back 45 (as shown in FIG. 4 A1), angling away and downward away from the back. In other examples A1 may be considered between 40 and 60 degrees. The angle A2 in FIG. 4, in some examples may be 60 degrees. In other examples, A2 may be between 40 and 80 degrees.

Embodiments of the berm 10 with attached berm supports 30 may include a wall support insert in the berm wall adjacent to the back 45, back 45 of the berm support attaches to the berm 10.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

We claim:

1. A berm containment system comprising:

a berm having a set of end walls, a set of side walls, a berm floor, a berm inner face and a berm outer face;

a set of berm supports;

wherein said set of berm supports mate with the berm along the berm outer face, wherein the berm supports are integrally formed one-piece berm supports with a first arm, a second arm, a panel, a flap and a back with a spine that folds into a blank position and extends into a support position, the berm support including inserts embedded within the first arm and the second arm, such that the arms serve as divided primary load paths.

2. The berm containment system of claim 1, wherein said set of berm supports mate with the berm along the berm outer face along the set of end walls and the set of side walls.

3. The berm containment system of claim 2, each berm support of the set of berm supports wherein the first arm and the second arm each forms a triangular shape.

4. The berm containment system of claim 2, the berm including a planar position and a deployed position.

5. The berm containment system of claim 4, wherein the first arm and the second arm of each berm support serves as a structural stiffener.

6. The berm containment system of claim 5, wherein each of the arms is attached to either the panel or the flap.

7. The berm containment system of claim 6, the panel and the flap including a connective face.

8. The berm containment system of claim 7, wherein the connective face of the panel is on an opposite side of the berm support in a blank position than the connective face of the flap.

9. The berm containment system of claim 8, wherein in the support position, the berm support takes on a substantially tetrahedron shaped structure.

10. The berm containment system of claim 9, wherein the panel and the flap interface with one another to secure the berm support in the support position.

11. The berm containment system of claim 9, wherein the inserts take on substantially the same shape as the first and the second arms berm.

12. The berm containment system of claim 11, wherein the back includes a substantially flat outer surface for attachment with the berm outer face along a berm end wall or berm side wall.

13. A berm support comprising:

a first arm, a second arm, the first arm and the second arm forming divided structural load paths, a flap, and a panel, wherein the berm support includes a blank position and a support position and is adapted to be alternated between the blank position and the support position, and a base formed by overlapping the panel and the flap.

14. The berm support of claim 13, the first arm and the second arm including inserts.

15. The berm support of claim 14, the panel and the flap each including a connective face.

16. The berm support of claim 15, wherein the panel and the flap interface with one another to secure the berm support in the support position.

17. The berm support of claim 16, wherein in the support position, the berm support takes on a substantially tetrahedron shaped structure.

18. The berm support of claim 17, wherein the berm support includes a back and the first arm and second arm extend from the back at the same angle to each engage the base at opposite sides.

19. The berm support of claim 13 including a pocket.

20. A kit for a berm system comprising:

a set of berm supports, each berm support including a first arm, a second arm, a flap, and a panel, wherein the berm support includes a blank position and a support position and is adapted to be alternated between the blank position and the support position;

a berm having a set of end walls, a set of side walls, a berm floor, a berm inner face and a berm outer face;

wherein said set of berm supports mate with the berm along the berm outer face, at least a portion of the berm supports including a pocket and a pocket flap for accepting a weight for urging an upright position for the berm support.

21. A method for supporting a berm comprising:

assembling a set of berm supports, connecting a first arm to a second arm in a berm support, structuring the first arm and the second arm to form divided structural load paths, forming a spine between the first arm and the second arm, connecting a flap to one of the arms, connecting a panel to one of the arms, including at least a partial separation between the flap and the panel, and forming the flap and the panel to be overlapped in a support position and to be separated in a blank position.

* * * * *